US011683635B2

(12) United States Patent
Degraeve

(10) Patent No.: US 11,683,635 B2
(45) Date of Patent: Jun. 20, 2023

(54) LOUDSPEAKER ARRAY WITH MULTIPLE DRIVERS

(71) Applicant: GP Acoustics International Limited, Pak Shek Kok (HK)

(72) Inventor: Sebastien Degraeve, Maidstone (GB)

(73) Assignee: GP ACOUSTICS INTERNATIONAL LIMITED, Pak Shek Kok (HK)

( * ) Notice: Subject to any disclaimer, the term of this patent is extended or adjusted under 35 U.S.C. 154(b) by 0 days.

(21) Appl. No.: 17/708,804

(22) Filed: Mar. 30, 2022

(65) Prior Publication Data

US 2022/0329931 A1 Oct. 13, 2022

(30) Foreign Application Priority Data

Apr. 8, 2021 (GB) ..... 2105018

(51) Int. Cl.

| | |
|---|---|
| ***H04R 1/24*** | (2006.01) |
| ***H04R 1/28*** | (2006.01) |
| ***H04R 1/02*** | (2006.01) |
| ***H04R 7/12*** | (2006.01) |
| ***H04R 1/40*** | (2006.01) |

(52) U.S. Cl.

CPC ..... *H04R 1/24* (2013.01); *H04R 1/023* (2013.01); *H04R 1/288* (2013.01); *H04R 1/403* (2013.01); *H04R 7/12* (2013.01); *H04R 1/025* (2013.01)

(58) Field of Classification Search

CPC ..... H04R 1/2896

See application file for complete search history.

(56) References Cited

U.S. PATENT DOCUMENTS 3,255,842 A * 6/1966 Vardeman ..... H04R 1/2811 181/147
3,918,551 A * 11/1975 Rizo-Patron ..... H04R 1/403 181/147
4,552,242 A 11/1985 Kashiwabara

FOREIGN PATENT DOCUMENTS

JP 2005012592 A 1/2005

OTHER PUBLICATIONS

Search Report issued for GB patent application Serial No. 2105018.2, dated Jul. 6, 2021.

* cited by examiner

*Primary Examiner* — Mark Fischer

(74) *Attorney, Agent, or Firm* — Westman, Champlin & Koehler, P. A.; Z. Peter Sawicki; Amanda M. Prose

(57) ABSTRACT

The present invention relates to a loudspeaker array comprising: a high frequency driver and a midrange driver forming a unitary assembly and configured to direct acoustic waves towards a listener in front of the loudspeaker array along an axis in a forward direction; at least one low frequency driver located generally rearwardly of the unitary assembly, and a woofer volume extending along and perpendicular to the axis between the at least one low frequency driver and the unitary assembly, in which the rear of the unitary assembly is configured and acoustically open so as to allow sound from the rear of the midrange driver to radiate rearwardly into the woofer volume.

15 Claims, 5 Drawing Sheets

LOUDSPEAKER ARRAY WITH MULTIPLE DRIVERS

CROSS REFERENCE TO RELATED APPLICATION

This application claims priority to and benefits of GB Patent Application No. 2105018.2, filed Apr. 8, 2021, the content of which is hereby incorporated by reference in its entirety.

FIELD OF THE INVENTION

The present invention relates to the field of loudspeakers, and especially relates to loudspeakers consisting of an enclosure containing a plurality of acoustic drivers, and particularly but not exclusively to loudspeakers in which two or more drivers are arranged coaxially.

BACKGROUND ART

A simple loudspeaker typically has a voice coil comprising a conductor through which a current may be passed, placed within a magnet assembly so that when current is passed through the voice coil an electromagnetic driving force is produced. This in turn drives a driven body, such as a diaphragm. Conventionally, this vibrates along the loudspeaker axis (i.e. the axis which passes from a front to a rear of the loudspeaker and which is substantially central to the loudspeaker, around which the loudspeaker is usually substantially rotationally symmetric), driven by a driver mechanism such as a voice coil as described. The movement of the diaphragm creates a pressure wave in the surrounding air, which propagates as a sound wave. It is common for several such loudspeakers, or acoustic drivers, to be combined in one unit or enclosure to form a loudspeaker in which the different drivers are each designed to produce a particular acoustic frequency range. For example, a loudspeaker may comprise a high frequency driver (or "tweeter"), a midrange driver and a low frequency driver (or "woofer").

One such loudspeaker is configured with three drivers which are coaxially and concentrically aligned, in which the tweeter is located on the axis with an annular midrange driver arranged concentrically around the tweeter, and an annular woofer arranged concentrically around the midrange driver. Such a configuration means that there is a large woofer annulus, which requires a large and heavy coil to drive it; this is expensive to manufacture and operate. A more economic arrangement, shown in FIG. 1, is to locate the tweeter 2 on the axis with an annular midrange driver 4 arranged concentrically around the tweeter 2, the two being in one assembly 6, with a conventional woofer 8 being located coaxially with and behind the assembly 6 and spaced axially from it; this spacing provides a woofer front cavity 10 between the woofer diaphragm 12 and the rear of the assembly 6 in which acoustic waves generated by the woofer 8 can propagate through a woofer aperture 14 (which forms an annulus around the assembly 6) towards a listener positioned towards the front of the system. The midrange/tweeter assembly is commonly mounted with an airtight shield 16 forming an airtight enclosure around the back of the midrange driver 4 and the tweeter 2, separating them from the front of the woofer 8, with the shape and configuration of the shield 16 and its spacing from the woofer diaphragm being designed to allow free motion of the woofer diaphragm and so that acoustic waves from the woofer 8 move freely through the woofer front cavity 10 to the woofer aperture 14, and thence forwardly towards the listener. These two types of loudspeaker are forms of "three driver coaxial arrays", a term used herein to denote these and other types/configurations of loudspeakers.

Typically, three driver coaxial arrays are used in recessed loudspeaker enclosures, such as in-ceiling and in-wall loudspeakers; they are also used in car audio systems, although these more often use only two drivers, a high frequency driver at the front and a low frequency driver behind. Three driver coaxial arrays are sometimes used in free standing loudspeaker enclosures.

A common problem with the arrangement shown in FIG. 1 is that the woofer front cavity 10 resonates at frequencies determined by the shape and size of the cavity. Typically, the response irregularities extend throughout the majority of the frequency range where the midrange driver operates. For example, the 10 inch (25.4 cm) woofer shown in FIG. 1 has an irregular response in the 400-2000 Hz frequency band.

A major consequence of this resonance is a large dip in the sound power response of the midrange driver, as shown as a theoretical prediction in FIG. 2. In this particular example, the resonance frequency is 950 Hz and it results in a 10 dB dip (NB in this document, "unfiltered" plots show the response where no filter is applied to the midrange driver, and "filtered" plots show the response when an electrical filter is applied to the midrange driver). Although these cavity resonances can be damped by incorporating sufficient acoustically absorbent material in the woofer cavity, the resulting acoustic resistance and turbulence due to high air velocity due to the constricted path strongly reduces the woofer output and the low-frequency output limiting the system efficiency.

SUMMARY OF THE INVENTION

The present invention is directed towards a loudspeaker array, comprising: a high frequency driver and a midrange driver forming a unitary assembly and configured to direct acoustic waves towards a listener in front of the loudspeaker array along an axis in a forward direction; at least one low frequency driver located generally rearwardly of the unitary assembly, and a woofer front cavity extending along and perpendicular to the axis between the at least one low frequency driver and the unitary assembly, in which the rear of the unitary assembly is configured and acoustically open so as to allow sound from the rear of the midrange driver to radiate rearwardly into the woofer front cavity with little restriction.

Providing an acoustically open rear (or "open back") to the unitary assembly (which might be achieved by removing the shield 16 in the arrangement of FIG. 1) allows the sound from the back of the midrange driver to radiate into the woofer front cavity and then through the annular woofer aperture into free space. The far-field sound pressure is therefore a combination of the front and the back radiation of the midrange driver leading to an acoustical short-circuit and a corresponding high-pass acoustic response (as shown in FIGS. 4*a* and 4*b*). A less obvious result of this arrangement is that the large dip in the power response is removed allowing a greatly improved response.

There may be acoustically absorbent material located in the woofer front cavity between the rear of the unitary assembly and the front of the at least one low frequency driver. This material should not fill the woofer front cavity, but instead should be positioned and configured so as to leave a clear path for acoustic waves from the low frequency driver(s) to travel towards a listener in front of the loudspeaker array. the acoustically absorbent material preferably extends so as substantially to separate the rear of the midrange driver from the low frequency driver. The acoustically absorbent material may form an enclosure surrounding the rear of the unitary assembly. The acoustically absorbent material is preferably porous or fibrous (i.e. not airtight), and may be a material such as foam (open cell or reticulated cell), felt or wadding. The acoustically absorbent material reduces resonances and irregularities in the frequency response, and increases the low frequency output of the midrange driver, reducing the effect of the acoustic short circuit between front and back of the driver.

The high frequency driver and the midrange driver may be substantially coaxial. There may be just one low frequency driver, which may be disposed coaxially with the unitary assembly. Alternatively, there may be more than one low frequency driver, the low frequency drivers being adapted in combination to direct low frequency acoustic waves in a substantially forward direction. In either case, the low frequency driver(s) is/are adapted and configured so as to direct acoustic waves forwardly towards the unitary assembly. Where there are several low frequency drivers, these may be arranged symmetrically around the axis.

There may be a woofer aperture extending around the unitary assembly through which low frequency acoustic waves from the low frequency driver radiate forwardly of the speaker system, in which acoustically absorbent material may be provided, located at or within the woofer aperture. Preferably this acoustically absorbent material does not fill the woofer aperture, so that the woofer can maintain a certain amount of flow. There may be a baffle provided around the unitary assembly, extending generally rearwardly of it and configured to prevent or reduce acoustic diffraction. Additional foam or other absorbent material at the periphery of the woofer cavity and/or the use of a curved baffle may reduce the diffraction (spreading of the acoustic waves as they pass through the woofer aperture) providing a smoother response and less angular variation at higher frequencies. There may be extending over all or part of the woofer aperture.

The low frequency driver may have a diaphragm having a first forward facing area and the woofer aperture may have a second forward facing area, the second area being a proportion of the first area sufficient to limit airflow velocity of low frequency acoustic waves at the woofer aperture to less than 10 $ms^{-1}$. The second area can be a proportion of the first area sufficient to limit airflow velocity of low frequency acoustic waves at the woofer aperture to less than 5 $ms^{-1}$. The second area may be that forward facing area which is not obstructed by any acoustically absorbent material. The ratio of the first and second areas may be between about 20% and about 70%, and more preferably between about 30% and about 50%.

A loudspeaker system may comprise a plurality of loudspeaker arrays in accordance with the invention.

BRIEF DESCRIPTION OF THE DRAWINGS

An embodiment of the present invention will now be described by way of example, with reference to the accompanying figures in which.

DETAILED DESCRIPTION OF THE EMBODIMENTS

Figure 1:
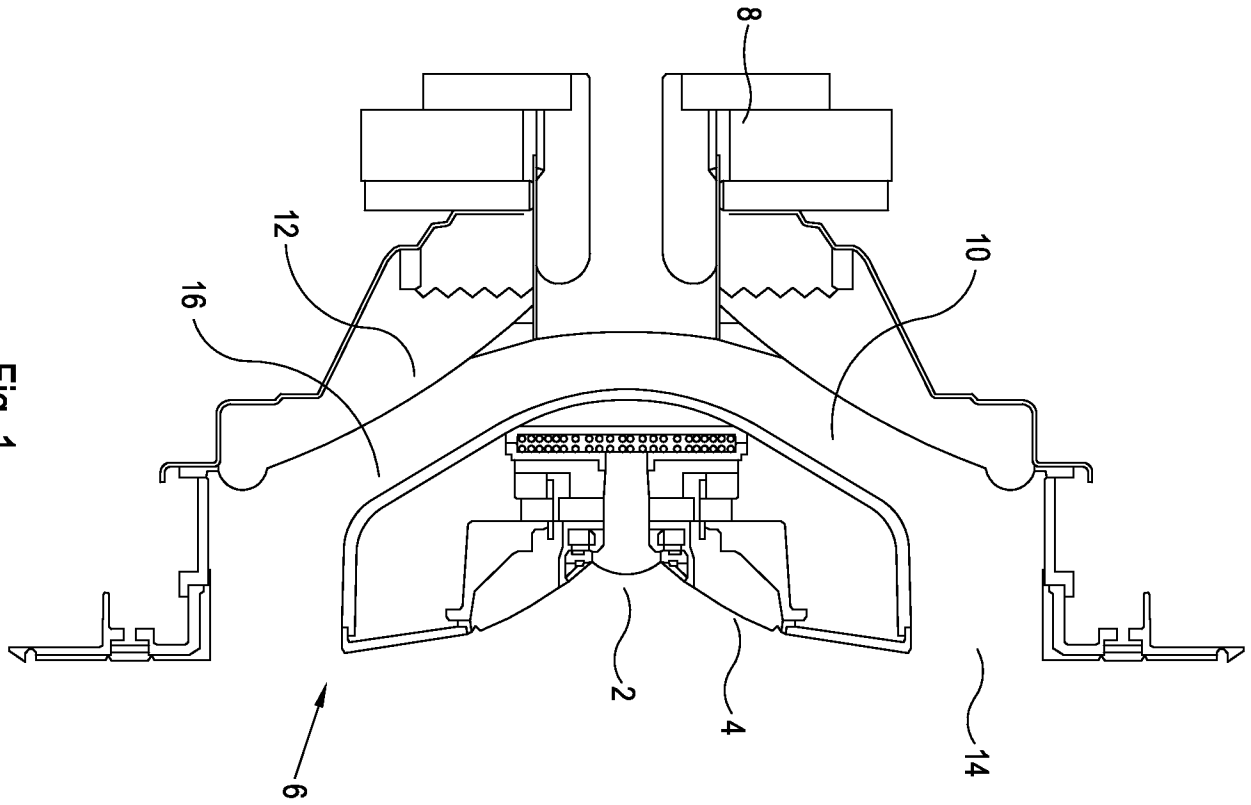
FIG. 1 shows a conventional three driver coaxial array loudspeaker in cross-section.
Figure 2:
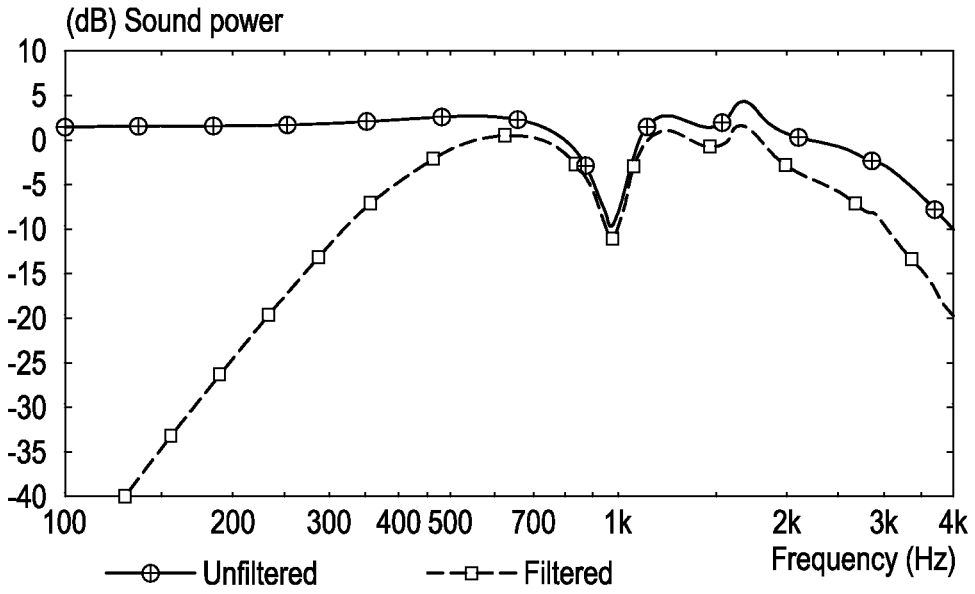
FIG. 2 shows the predicted sound power response of the loudspeaker of FIG. 1.

FIG. 1 shows a prior art loudspeaker array which is described above. FIG. 2 shows the theoretical sound power response of the conventional loudspeaker array of FIG. 1, and is also explained above.

Figure 3A:
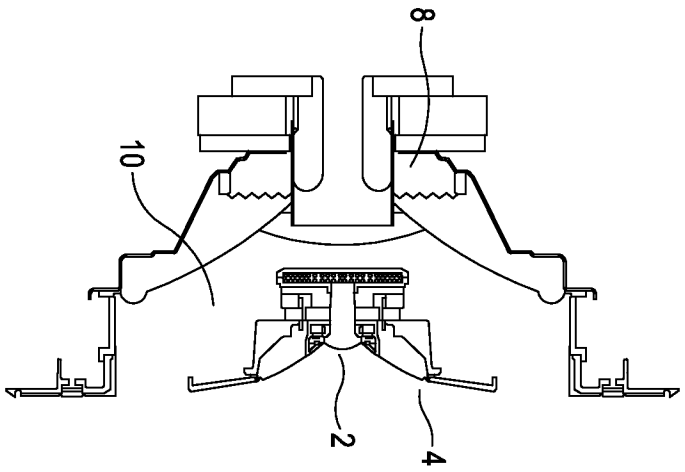
FIGS. 3*a* and 3*b* show embodiments of three driver coaxial array loudspeakers in accordance with the invention in cross-section.
Figure 3B:
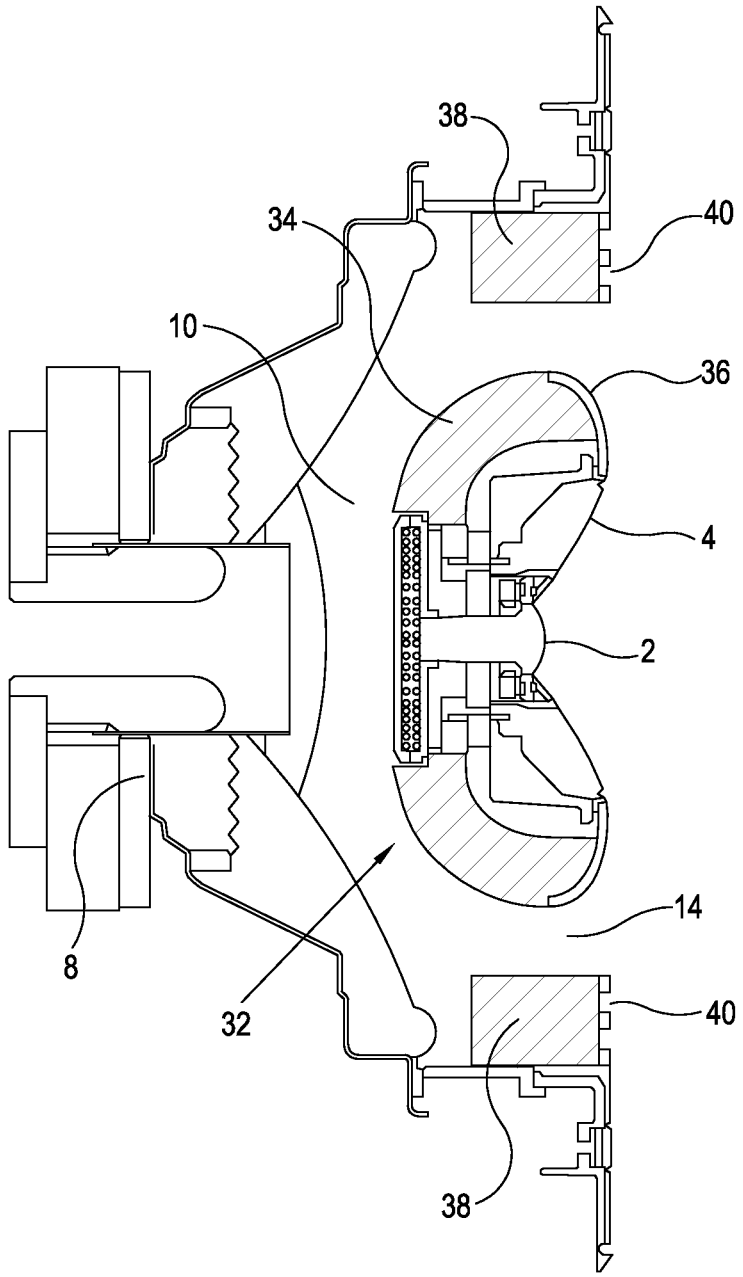

FIGS. 3*a* and 3*b* show two embodiments of loudspeaker arrays in accordance with the present invention; elements of these embodiments which are substantially the same as those in the loudspeaker array of FIG. 1 bear the same reference numerals as the elements in FIG. 1. In these drawings the front, as that term is applied herein to any element of the loudspeaker array, and the forward direction, as that term is applied herein to any direction, mean the right hand side of the drawing, and the terms back, rear and rearwardly mean the left hand side of the drawing. The axis referred to herein runs horizontally, left to right in the drawings. As in FIG. 1, the tweeter 2 is located on the left/right horizontal axis with an annular midrange driver 4 arranged concentrically around the tweeter 2, the two being substantially in the same plane, and mounted in a single, unitary assembly 6. The diaphragms of the midrange driver and the tweeter are arranged so as to be closely spaced where they are adjacent. A conventional woofer 8 is located coaxially with and behind the assembly 6 and spaced axially from it; this positioning leaves a woofer front cavity 10 between the woofer diaphragm 12 and the rear of the assembly 6, through which cavity acoustic waves generated by the woofer 8 can propagate forwardly and radially outwardly towards a woofer aperture 14 (which forms an annulus around the assembly 6) and thence towards a listener positioned in front of the system (i.e. to the right hand side of the drawing). In FIG. 3*a* the midrange driver shield 16 of the conventional loudspeaker array of FIG. 1 is removed, leaving nothing but empty space in the woofer front cavity 10 between the rear of the midrange driver 4 (and the rear of the tweeter 2) and the front of the woofer 8.

In FIG. 3*b* the shield of FIG. 1 is replaced with an enclosure 32 formed of an open cell foam 34 which interrupts the acoustic path from the rear of the midrange driver 2 towards the woofer 8 and a curved baffle 36, but is adapted to not substantially obstruct acoustic waves travelling rearwardly from the rear of the midrange driver 4. Additional acoustically absorbent material 38 (it can be made of the same material as or of a different material to the material 34 forming part of the enclosure 32) is provided at the woofer aperture 14 and a grille 40 is provided overlying the front of this material 38 (or it may extend over the entire woofer aperture 14) to conceal it from view and to protect it.

Figure 4A:
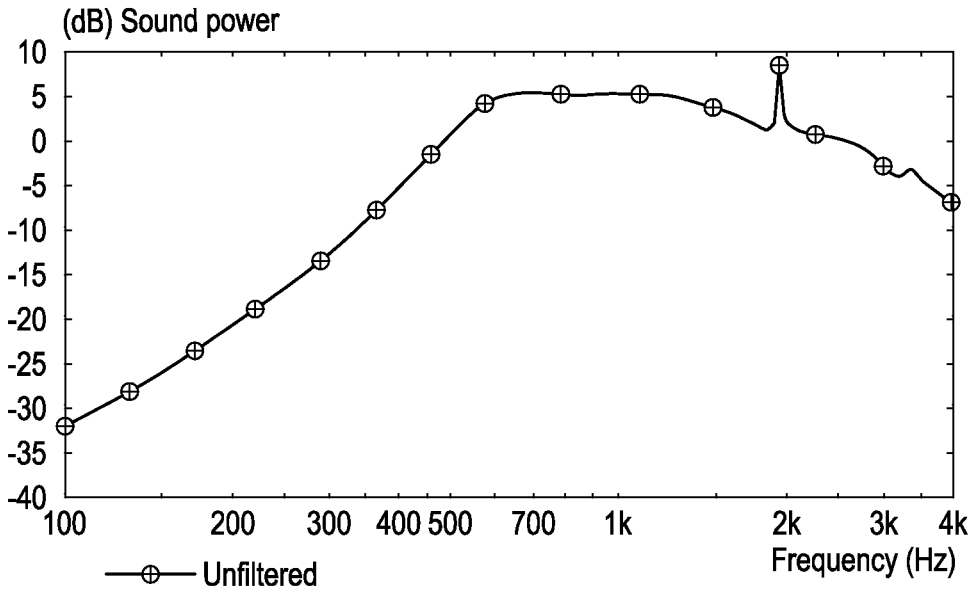
FIGS. 4*a* and 4*b* show the predicted sound power response of the loudspeakers of FIGS. 3*a* and 3*b* respectively.
Figure 4B:
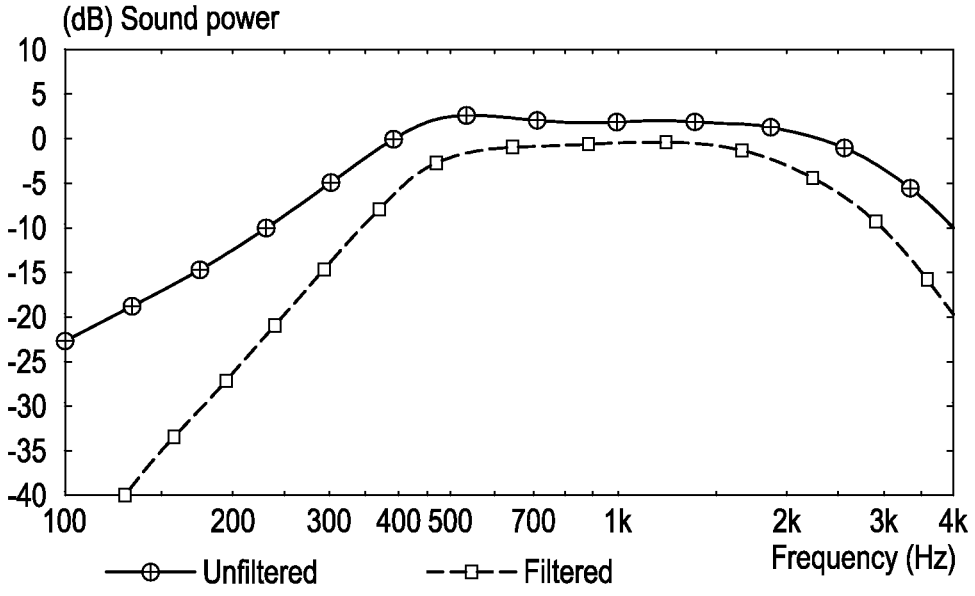
Figure 5A:
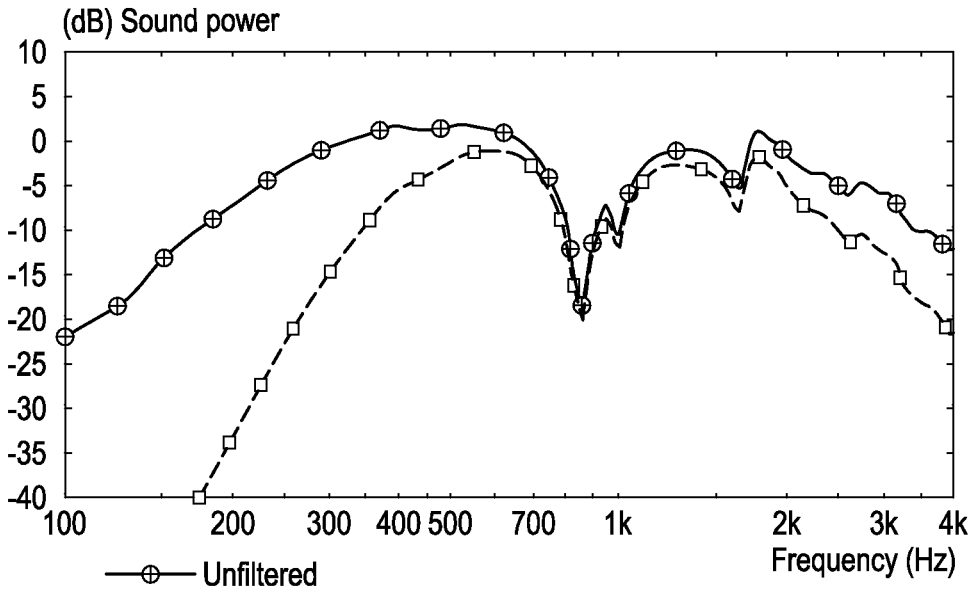
FIG. 5*a* shows the measured sound power response of the prior art loudspeaker of FIG. 1.
Figure 5B:
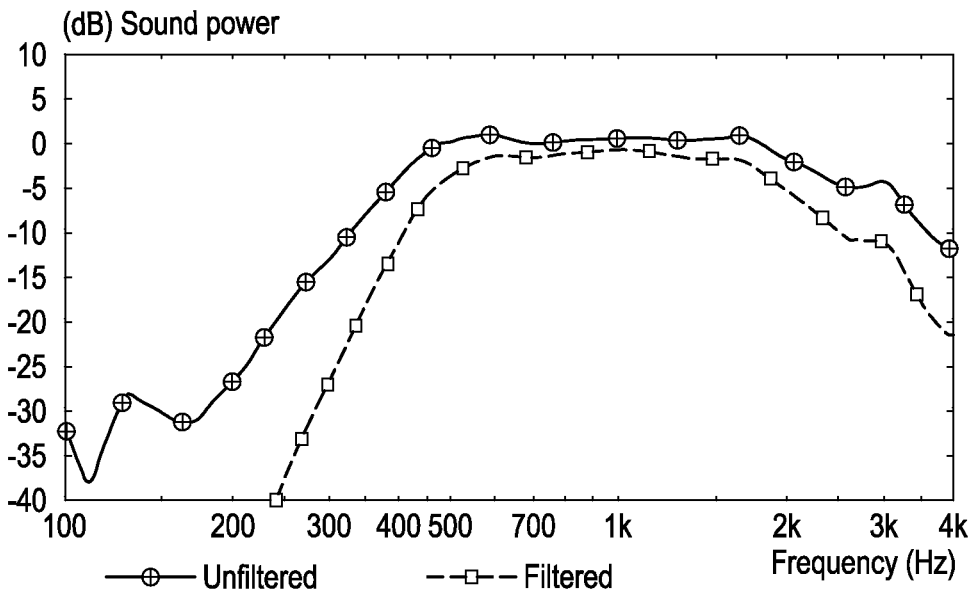
FIG. 5*b* shows the measured sound power response of the same driver used in the arrangement of FIG. 3*b*.

FIGS. 4*a* and 4*b* show the theoretical sound power response of the loudspeakers of FIGS. 3*a* and 3*b*, respectively. As can be seen, the large (−10 dB) dip in the response at around 950 Hz present in FIG. 2 should be substantially removed. This has been confirmed in our experiments, in which the sound power response of the midrange driver assembly shown in FIG. 1 was measured and is shown in FIG. 5*a*; this plot conforms closely to the predicted result shown in FIG. 2. The same midrange assembly was then used in the arrangement of FIG. 3*b*, and the resulting sound power response is shown in FIG. 5*b*; again it can be seen that this result conforms closely to the predicted response shown in FIG. 4*b*, and represents a significant improvement in performance over the conventional loudspeaker arrangement of FIG. 1.

The choice of the area of the woofer aperture as a proportion of the area of the woofer diaphragm 12 is significant: if this proportion is too small then diffraction occurs, and this is detrimental to sound quality. If the proportion is too high then there is a high airflow velocity in the woofer aperture 14, which causes undesirable noise. We have found that an area ratio range of between 20% and 70% is suitable for an acceptable product, but that a range of between about 30% and about 50% is preferable.

It will of course be understood that many variations may be made to the above-described embodiment without departing from the scope of the present invention. For example, the embodiment above is a substantially circular loudspeaker array, but the illustrated circular midrange driver diaphragm can be any shape (e.g. square, oval, cloverleaf) provided its rear acoustic radiation is directed into the woofer front cavity. Preferably the shape of the tweeter is the same as that of the midrange driver, as may be the shape of the or each low frequency driver. We have mentioned the possibility of providing multiple woofers, these may be arranged symmetrically, such as in the known front-to-front and back-to-back arrangements of two woofers (force cancelling arrays), or multiple woofers may be arranged around a cavity and arranged to direct their aggregated acoustic waves forwardly (as in US 2020/0396536, for example). The tweeter and midrange driver may be coplanar, or their respective planes may be spaced along the axis provided they are in a single assembly and there is no significant distance between the inner edge of the midrange driver and the outer edge of the tweeter. The way the unitary assembly 6 is supported is not clearly shown in the drawings; however, it is well-known in the art that this support may comprise a generally radial, "spider" assembly. The support may also be one which is substantially axial, where the assembly is supported on a stalk which extends rearwardly or generally rearwardly, or a number of stalks which extend generally rearwardly.

Where different variations or alternative arrangements are described above, it should be understood that embodiments of the invention may incorporate such variations and/or alternatives in any suitable combination.

The invention claimed is:

1. A loudspeaker array, comprising:

a high frequency driver and a midrange driver forming a unitary assembly and configured to direct acoustic waves towards a listener in front of the loudspeaker array along an axis in a forward direction;

at least one low frequency driver located generally rearwardly of the unitary assembly, and a woofer volume extending along and perpendicular to the axis between the at least one low frequency driver and the unitary assembly, in which the rear of the unitary assembly is configured and acoustically open so as to allow sound from the rear of the midrange driver to radiate rearwardly into the woofer volume.

2. The loudspeaker array according to claim 1, in which the high frequency driver and the midrange driver are substantially coaxial.

3. The loudspeaker array according to claim 1, comprising one low frequency driver which is disposed coaxially with the unitary assembly.

4. The loudspeaker array according to claim 1, in which there is more than one low frequency driver, the low frequency drivers being adapted in combination to direct low frequency acoustic waves in a substantially forward direction.

5. The loudspeaker array according to claim 4 in which the low frequency drivers are arranged symmetrically around the axis.

6. The loudspeaker array according to claim 1 in which an acoustically absorbent material is located in but does not fill the woofer volume.

7. The loudspeaker array according to claim 6 in which the acoustically absorbent material extends so as substantially to separate the rear of the midrange driver from the low frequency driver.

8. The loudspeaker array according to claim 1, in which there is a woofer aperture extending around the unitary assembly through which low frequency acoustic waves from the low frequency driver radiate forwardly of the speaker system, and in which acoustically absorbent material is located at or within the woofer aperture.

9. The loudspeaker array according to claim 8 in which the acoustically absorbent material does not fill the woofer aperture.

10. The loudspeaker array according to claim 8, further comprising a grille extending over the woofer.

11. The loudspeaker array according to claim 8, in which the low frequency driver has a diaphragm having a first forward facing area and the woofer aperture has a second forward facing area, the second area being a proportion of the first area sufficient to limit airflow velocity of low frequency acoustic waves at the woofer aperture to less than 10 $ms^{-1}$.

12. The loudspeaker array according to claim 11, in which the second area is a proportion of the first area sufficient to limit airflow velocity of low frequency acoustic waves at the woofer aperture to less than 5 $ms^{-1}$.

13. The loudspeaker array according to claim 12, in which the ratio of the first and second areas is between 20% and 70%, and more preferably between 30% and 50%.

14. The loudspeaker array according to claim 1, in which there is a woofer aperture extending around the unitary assembly through which low frequency acoustic waves from the low frequency driver radiate forwardly of the speaker system, and in which a baffle is provided around the unitary assembly, extending generally rearwardly of it and configured to prevent or reduce acoustic diffraction.

15. A loudspeaker system comprising a plurality of loudspeaker arrays according to claim 1.

* * * * *